US012426702B2

(12) United States Patent
Aust

(10) Patent No.: US 12,426,702 B2
(45) Date of Patent: Sep. 30, 2025

(54) REJUVENATABLE WIRE BRUSH SOCKET

(71) Applicant: Louis Aust, Johnstown, PA (US)

(72) Inventor: Louis Aust, Johnstown, PA (US)

( * ) Notice: Subject to any disclaimer, the term of this patent is extended or adjusted under 35 U.S.C. 154(b) by 0 days.

(21) Appl. No.: 18/976,851

(22) Filed: Dec. 11, 2024

(65) Prior Publication Data

US 2025/0098844 A1 Mar. 27, 2025

Related U.S. Application Data

(60) Provisional application No. 63/608,648, filed on Dec. 11, 2023.

(51) Int. Cl.
*A46B 13/00* (2006.01)
*A46D 3/00* (2006.01)

(52) U.S. Cl.
CPC ..... *A46B 13/001* (2013.01); *A46D 3/00* (2013.01)

(58) Field of Classification Search
CPC ..... B08B 1/12; A46B 13/001; A46B 13/003
See application file for complete search history.

(56) References Cited

U.S. PATENT DOCUMENTS 5,269,104 A * 12/1993 DiBiagio ..... B25F 5/001 15/23
6,983,508 B2 * 1/2006 Saurer ..... B08B 9/023 15/104.04

* cited by examiner

*Primary Examiner* — Shay Karls
(74) *Attorney, Agent, or Firm* — Blynn L. Shideler; Krisanne Shideler; BLK Law Group

(57) ABSTRACT

A rejuvenatable wire brush socket includes a tubular socket body, formed of a material suitable for cutting such as plastic; a hollow socket at one end of the socket body configured for receiving workpieces to be engaged by and worked upon by the rejuvenatable wire brush socket; an array of wire bristles extending radially inwardly within the hollow socket configured to engage the workpieces within the hollow socket; at least one cut off line on the exterior of the socket body and aligned with the array of wire bristles wherein cutting the tubular socket body along the cut off line will form a new end of the socket body and positions a new set of wire bristles of the array of wire bristles adjacent the new end of the socket body; and a socket drive element at an opposed end of the socket body.

10 Claims, 2 Drawing Sheets

REJUVENATABLE WIRE BRUSH SOCKET

RELATED APPLICATIONS

This application claims the benefit of U.S. Patent Application Ser. No. 63/568,598 filed Dec. 11, 2023 titled "Rejuvenatable Wire Brush Socket" which application is incorporated herein by reference.

BACKGROUND OF THE INVENTION

1. Field of the Invention

This invention generally relates to wire brush sockets for cleaning debris from bolt heads, nuts and the like.

2. Background Information

Bolt heads and nuts (and other parts) used in construction, automotive applications, and industrial applications often accumulate debris such as dirt, corrosion, paint, and other unwanted matter on their surface over time due to their exposure to the elements. If left uncleaned, the accumulated debris can cause damage to the fasteners and tools during maintenance and repair operations. For example, using an air wrench to remove a fastened nut from an uncleaned stud can cause the debris to become impacted in the thread causing the nut to grind the thread damaging the thread, and also, potentially, damaging the air wrench.

The use of hand held wire brushes to remove debris from fasteners and other parts is well-known and well-practiced in the art. A wire brush generally is a tool consisting of a brush whose bristles are made of wire, most often steel wire. The steel used is generally a medium to high carbon variety and very hard and springy. Other wire brushes feature bristles made from brass or stainless steel, depending on application. Wires in a wire brush can be held together by epoxy, staples, or other binding. Handheld wire brushes usually either have a handle of wood or plastic. The origins of the hand held wire brush are unknown, although it has been reported that the ancient Romans used a similar tool in the manufacture of roof tiles.

The conventional wire brush is primarily an abrasive implement, used for cleaning rust, removing paint and the like. It is also used to clean surfaces and to create a better conductive area for attaching electrical connections, such as those between car battery posts and their connectors, should they accumulate a build-up of grime and dirt. When cleaning stainless steel, it is advisable to use a stainless steel bristle wire brush, as a plain carbon steel brush can contaminate the stainless steel and cause rust spots to appear. Brass bristle brushes are used on softer surfaces or when it is necessary to clean a harder surface without marring it. Brass bristle brushes are also used in potentially flammable environments where non-sparking tools are required. Wire brushes are also used to clean the teeth of large animals, such as crocodiles and pigs. They are also used widely in surface engineering to clean castings prior to painting.

The approach of using a hand held wire brush to remove debris from bolt heads and nuts (and other parts) can be time-consuming, labor-intensive and may be ineffective in removing particularly stubborn debris. Wire brushes have also commonly been formed into a wheel with outward radially extending bristles, or cup shaped rotary element with axially extending bristles for use on angle grinders, bench grinders, pistol-grip drill motors, or other power tools.

Alternatively, brush elements within a socket have been proposed in numerous implementations over time to alleviate some of the issues with the structures discussed above, although their use in practice has been limited. Consider, for example, U.S. Pat. No. 9,216,439, from 2015 and which is incorporated herein by reference, disclosing a rotary brush socket attachment for use with a tool, such as a power tool, to remove rust, paint, debris, and other unwanted matter accumulated on the surface of fasteners and other parts used in construction, automotive applications, and industrial applications. The rotary brush socket attachment comprises a body oriented along a longitudinal axis, an engagement portion for removably engaging a tool, and a brush portion. The brush portion comprises a hollow extending at least partially into the body along the longitudinal axis, and bristles extending from the interior surface of the hollow towards the longitudinal axis.

The patent literature includes additional representative examples including U.S. Pat. No. 1,717,554 from 1926 that discloses polishing disks positioned inside of a barrel. U.S. Pat. No. 2,629,121 from 1953 discloses a rotatable wire brush tool for cleaning pipe threads. U.S. Pat. No. 3,188,674 from 1965 discloses a wire brush positioned inside of a hollow rigid cylindrical housing mountable to a power drill. U.S. Pat. No. 4,301,567 from 1981 discloses a power drill mountable first wire brush element and second wire brush element positioned inside a hollow cylindrical housing. U.S. Pat. No. 4,862,549 from 1989 also discloses a drill mountable first wire brush element and second wire brush element positioned inside a hollow cylindrical housing, specifically for pipe soldering or brazing preparation. U.S. Pat. No. 5,269,104 from 1993 discloses bristles positioned inside of a stepped female cleaning tool. U.S. Pat. No. D528,891 from 2006 discloses a design for a hand tool for abrading oxides from copper electrical wires. U.S. Pat. No. 6,983,508, also from 2006, discloses first bristles and second bristles positioned inside an inner member. U.S. Pat. No. 8,069,521 from 2011 discloses wire bristles positioned inside of a wire brush socket assembly. These patents represent a review, over time, of the state of the art and are incorporated herein by reference.

There remains a need in the art to provide a wire brush socket for cleaning debris from bolt heads, nuts and the like which is effective and cost efficient to be widely adopted by user's in the industry.

SUMMARY OF THE INVENTION

The various embodiments and examples of the present invention as presented herein are understood to be illustrative of the present invention and not restrictive thereof and are non-limiting with respect to the scope of the invention.

The present invention provides a rejuvenatable wire brush socket which includes a tubular plastic socket body; a hollow socket at one end of the socket body configured for receiving workpieces to be engaged by, and worked upon by, the rejuvenatable wire brush socket; an array of wire bristles extending radially inwardly within the hollow socket configured to engage the workpieces within the hollow socket; at least one cut off line on the exterior of the plastic socket and aligned with the array of wire bristles wherein cutting the tubular plastic socket body along the cut off line will form a new end of the socket body and positions a new set of wire bristles of the array of wire bristles adjacent the new end of the socket body; and a socket drive element at an opposed end of the socket body.

One aspect of the present invention provides a method of rejuvenating a wire brush socket comprising the steps of Providing a rejuvenatable wire brush socket with a tubular socket body, a hollow socket at one end of the socket body configured for receiving workpieces to be engaged by and worked upon by the rejuvenatable wire brush socket, an array of wire bristles extending radially inwardly within the hollow socket configured to engage the workpieces within the hollow socket, at least one cut off line on the exterior of the socket body and aligned with the array of wire bristles; and cutting the tubular socket body along a cut off line to form a new end of the socket body and position a new set of wire bristles of the array of wire bristles adjacent the new end of the socket body.

These and other advantages of the present invention are described below in connection with the attached figures in which like reference numerals represent like elements throughout.

BRIEF DESCRIPTION OF THE PREFERRED EMBODIMENTS

Figure 1:
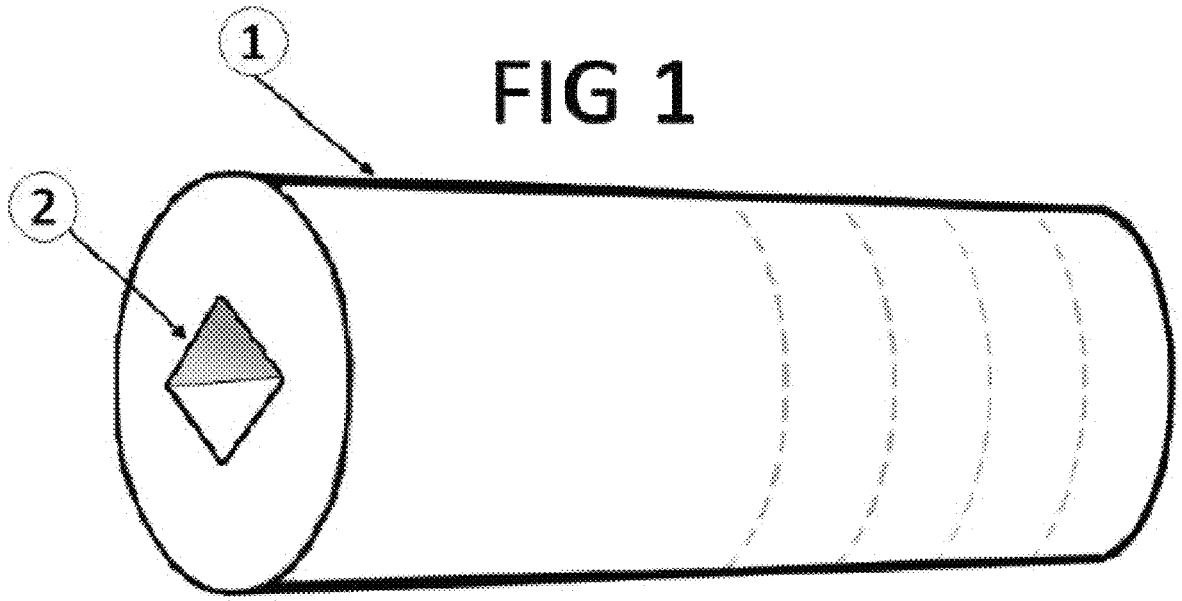
FIG. 1 is a schematic rear perspective view of rejuvenatable wire brush socket according to one embodiment of the present invention.
Figure 2:
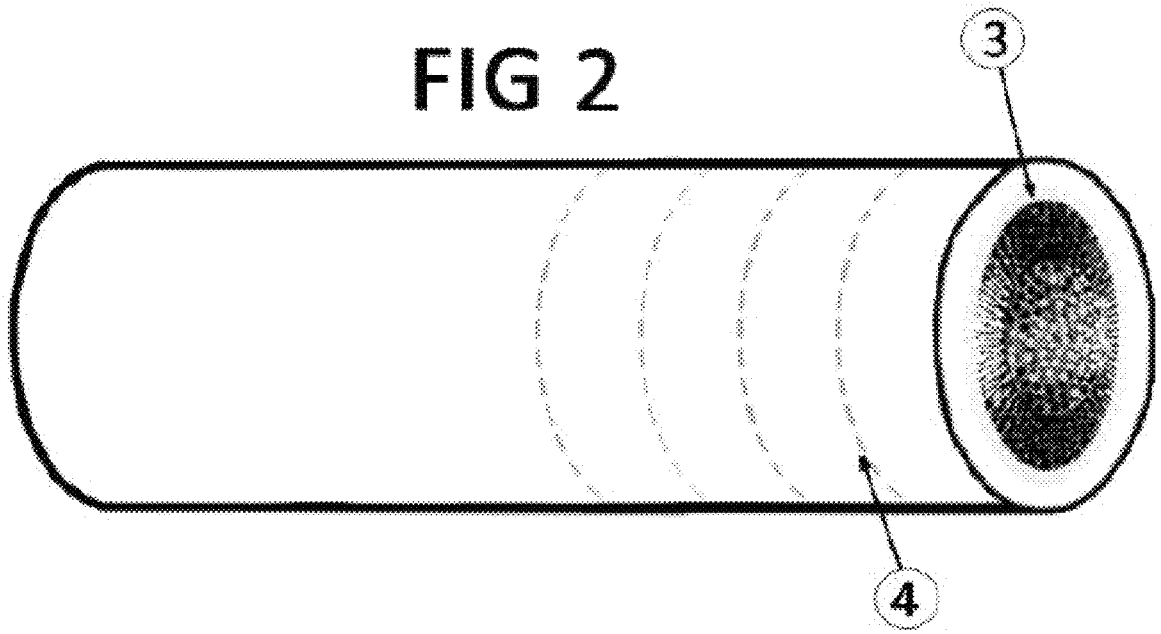
FIG. 2 is a schematic front perspective view of the rejuvenatable wire brush socket of FIG. 1.
Figure 3:
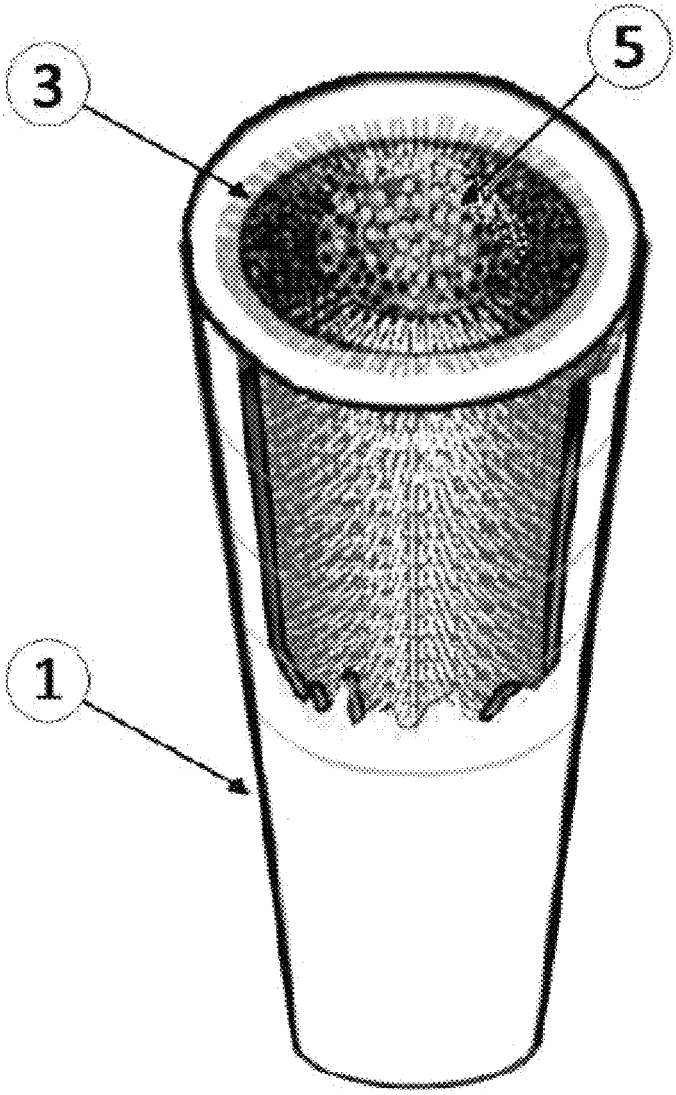
FIG. 3 is a schematic front perspective view, partially in section, of the rejuvenatable wire brush socket of FIG. 1.

The present invention provides a rejuvenatable wire brush socket shown in FIGS. 1-3, and may be referenced herein as the socket or the tool or similar terms. The socket includes a tubular socket body 1 formed of a material suitable for easily cutting such as preferably plastic; a hollow socket 5 at one distal end of the socket body 1 configured for receiving workpieces (not shown) to be engaged by, and worked upon by, the rejuvenatable wire brush socket; an array of wire bristles 3 extending radially inwardly within the hollow socket 5 configured to engage the workpieces within the hollow socket 5; at least one cut off line 4 on the exterior of the plastic socket body 1 and aligned with the array of wire bristles 3, wherein cutting the tubular plastic socket body 1 along the cut off line will form a new distal end of the socket body 1 and positions a new set of wire bristles 3 of the array of wire bristles 3 adjacent the new distal end of the socket body 1; and a socket drive element 2 at an opposed proximate end of the socket body 1. In short, the invention is a debris cleaning tool, such as for nuts and bolts.

As detailed herein the present invention provides a rejuvenatable wire brush socket. The socket is rejuvenatable because as the wire bristles 3 on an outer set of bristles 3 adjacent the open end of the socket body 1 become worn or clogged with debris (rust, paint, oil etc.) the socket can be rejuvenated by cutting the plastic body along the next trim or cut off line 4. The cutting the tubular plastic socket body 1 along the cut off line will form a new end of the socket body 1 and position a new set of wire bristles 3 of the array of wire bristles 3 adjacent an end of the socket body 1 effectively creating a new socket working surface.

The plastic tubular body 1 is formed to be easily cut by users in the field to rejuvenate the socket. The plastic tubular body 1 gives sufficient rigidity to the tool and allows the body 1 to be easily cut with a conventional utility knife, hack saw or other cutting tool commonly used by workmen. The plastic tubular body 1 is cylindrical and sized for the desired range of workpieces. The plastic tubular body 1 may have a knurled outer surface to improve gripping, as there may be some uses where the user manually grips the rejuvenatable wire brush socket and twists the socket in rotational movement back and forth on a workpiece, such as on a nut or bolt head.

The hollow socket 5 is at one end of the plastic tubular body 1, specifically the distal end of the socket body 1, which is either the original distal end of the body 1 or a new distal end formed by trimming the socket body 1 along cut off lines 4. The hollow socket 5 is configured for receiving workpieces (not shown) to be engaged by, and worked upon by, the rejuvenatable wire brush socket and may effectively be formed as cylindrical and large enough to accommodate the array of wire bristles 3. A backing layer of the array of wire bristles 3 is coupled to the inner wall of the body 1 forming the hollow socket 5.

As the body 1 is preferably plastic, and preferably injection molded, the body 1 may form the socket 5 with intervening circular ribs aligned with the cut off lines, whereby the array of wire bristles 3 is not positioned along the intervening annular ribs and in this embodiment the user is only cutting through the plastic material of the body 1 and not the backing layer of the wire bristles 3.

An array of wire bristles 3 extending radially inwardly is provided within the hollow socket 5 configured to engage the workpieces within the hollow socket 5. The array of wire bristles 3 may be referred to herein interchangeably as wire bristles 3 or bristles 3. The wire bristles 3 are easily formed as straight wires in an array in a backing layer that is rolled up and inserted into, and fastened within, the hollow socket 5, such as with adhesive, ultrasonic welding, or the like.

The "straight" wires forming the bristles 3 may be formed with some kinks or bends in them to increase cleaning or abrading capabilities of the tool, but simple actually straight lengths of metal wire has proven efficient and effective. The wire bristles 3 may be metal, such as stainless steel, or even brass for some applications. Other materials may be used to form the wire bristles 3 such as nylon wires impregnated with abrasive particles, namely any materials known for forming wire brushes. The array of wire bristles 3 could take other form that straight radial bristles, for example they could be loops (still extending radially inwardly) in which both ends of a single bristle are embedded within the backing layer, however the simple straight wire configuration with a single backing layer embedding point is easy to form and easy to align gaps in the array of bristles 3 with the cut off lines 4 so the user is not cutting through the wire bristle elements 3 when rejuvenating the socket.

As noted the socket includes least one visible cut off line 4 on the exterior of the plastic socket body 1 and which is aligned with the array of wire bristles 3, specifically aligned with gaps in the wire bristle elements 3 in the array, wherein cutting the tubular plastic socket body 1 along the cut off line 4 will generally avoid cutting through the bristle elements and will form a new end of the socket body 1 and positions a new set of wire bristles 3 of the array of wire bristles 3 adjacent the new distal end of the socket body 1.

Each cut off line 4 is visible to the user and may be formed as a small groove in the outer surface of the body 1 to form a cutting guide for the user. Preferably a plurality of cut off lines 4 are positioned along the socket body 1 and at a distance generally spaced a distance at least equal to the height of a conventional bolt head or nut body. The space between the distal end of the socket and the next cut off line 4 defines a typical working space for the socket where a conventional workpiece will be received and worked upon.

The socket includes a conventional socket drive element 2 at an opposed end or proximal end of the socket body 1. The socket drive will typically be ¼", ⅜" or ½" drive sizes and generally square, however other sizes and shapes are possible. The drive element 2 allows the socket to be powered or driven in rotation with a pneumatic wrench (air wrench) or hand held drill with attachment, or alternatively to be rotated or powered manually by a ratchet wrench or a speed handle or speed brace.

In use, the rejuvenatable wire brush socket of the invention may be used in a generally conventional fashion upon bolt heads and nuts and other parts (workpiece) that have accumulated debris such as dirt, corrosion, paint, and other wanted matter on their surface over time due to their exposure to the elements. The user merely places the socket (generally with the desired driving tool attached) over the workpiece such that the workpiece is received within the hollow socket 5 and engaged by the array of bristles 3 (generally the set of bristle elements of the array closest the distal end of the socket) and the socket is rotated (typically by a driver) to clean (remove debris from) the workpiece (or to surface treat the workpiece). As detailed above the present invention provides a rejuvenatable wire brush socket whereby as the wire bristles elements on an outer set of bristles 3 adjacent the open end of the socket body 1 become worn or clogged with debris (rust, paint, oil etc.), the socket can be rejuvenated by cutting the plastic body along the next trim or cut off line 4 (the next one being the one closest to the distal end of the socket). The cutting the tubular plastic socket body 1 along the cut off line will form a new distal end of the socket body 1 and position a new set of wire bristle elements of the array of wire bristles 3 adjacent an end of the socket body 1 effectively creating a new socket working surface.

The rejuvenated tool is important in the field to allow the use to have an effective efficient tool. There are many applications where it is impractical to have the operator stop and go back to central area to obtain a second replacement tool when the first is no longer operating and the present invention allows users to have the next revitalized tool with them when one working segment of the present invention wears out. The user need only have a cutting or trimming tool, which they will typically have on them anyway. Additionally, when the tool is down to the last working area (e.g. no more cut lines 4), the tool itself provides this visual indication to the user such they know the tool is near then end of its useful life.

In operation, the tool can be used in one direction (e.g., clockwise) and then used in the opposite direction (e.g., counterclockwise) to extend the life of each working section of wire bristles 3. Further, an air compressor can be used to remove debris from the hollow socket 5, again to extend the life of each working section of the wire bristles 3. It is note-worthy that the tool is generally "unbreakable" in typical applications in that because the tool is used to remove debris there is no substantive torque that would damage the tool, the workpiece or the driver, and this fact facilitates the use of plastic for the body 1.

The tool of the invention is particularly useful in restoration applications. As a particularly specific example, in restoring a '57 Chevy, aficionados prefer as much original components as possible. Use of the tool of the present invention facilitates maintaining original nuts and bolts by being able to efficiently remove rust and debris therefrom. Other restorations projects would see similar benefits.

Additionally, the present invention allows the user to reach areas that he cannot reach with his hand, particularly if using extensions on a driver. Furthermore, the wire bristles 3 and the hollow socket 5 of the socket of the invention extends most of the length of the socket body 1 to the socket drive element 2, and can provide a deep socket application (before the initial trimming) like when used on a muffler clamp. The tool of the present invention will come in different sizes with each size associated with a range of bolt heads and nut heads.

The above description is representative of the present invention but not restrictive thereof. The full scope of the present invention are set forth in the appended claims and equivalents thereto.

What is claimed is:

1. A method of rejuvenating a wire brush socket comprising the steps of:

Providing a rejuvenatable wire brush socket with a tubular socket body, a hollow socket at one end of the socket body configured for receiving workpieces to be engaged by and worked upon by the rejuvenatable wire brush socket, an array of wire bristles extending radially inwardly within the hollow socket configured to engage the workpieces within the hollow socket, and at least one cut off line on the exterior of the socket body and aligned with the array of wire bristles; and Cutting the tubular socket body along a cut off line to form a new end of the socket body and position a new set of wire bristles of the array of wire bristles adjacent the new end of the socket body.

2. The method of rejuvenating a wire brush socket according to claim 1 wherein the tubular socket body is plastic and including a socket drive element at an opposed end of the socket body.

3. The method of rejuvenating a wire brush socket according to claim 2 wherein the at least one cut off line on the exterior of the socket body is aligned with gaps in the array of wire bristles wherein the cutting the tubular socket body along the cut off line will not cut any bristles.

4. The method of rejuvenating a wire brush socket according to claim 3 further including a plurality of the cut off lines on the exterior of the socket body, wherein the step of cutting the tubular socket body along a cut off line to form a new end of the socket body and position a new set of wire bristles of the array of wire bristles adjacent the new end of the socket body is repeated.

5. The method of rejuvenating a wire brush socket according to claim 3 further including four of the cut off lines on the exterior of the socket body, wherein the step of cutting the tubular socket body along a cut off line to form a new end of the socket body and position a new set of wire bristles of the array of wire bristles adjacent the new end of the socket body is repeated.

6. The method of rejuvenating a wire brush socket according to claim 1 wherein the at least one cut off line on the exterior of the socket body is aligned with gaps in the array of wire bristles wherein the cutting the tubular socket body along the cut off line will not cut any bristles.

7. The method of rejuvenating a wire brush socket according to claim 6 further including a plurality of the cut off lines on the exterior of the socket body, wherein the step of cutting the tubular socket body along a cut off line to form a new end of the socket body and position a new set of wire bristles of the array of wire bristles adjacent the new end of the socket body is repeated.

8. The method of rejuvenating a wire brush socket according to claim 6 further including four of the cut off lines on the exterior of the socket body, wherein the step of cutting the tubular socket body along a cut off line to form a new end of the socket body and position a new set of wire bristles of the array of wire bristles adjacent the new end of the socket body is repeated.

9. The method of rejuvenating a wire brush socket according to claim 1 further including a plurality of the cut off lines on the exterior of the socket body, wherein the step of cutting the tubular socket body along a cut off line to form a new end of the socket body and position a new set of wire bristles of the array of wire bristles adjacent the new end of the socket body is repeated.

10. The method of rejuvenating a wire brush socket according to claim 1 further including four of the cut off lines on the exterior of the socket body, wherein the step of cutting the tubular socket body along a cut off line to form a new end of the socket body and position a new set of wire bristles of the array of wire bristles adjacent the new end of the socket body is repeated.

* * * * *